United States Patent [19]

Hackenberg

[11] 4,394,905

[45] Jul. 26, 1983

[54] AUTO PLATFORM CARTON

[75] Inventor: Robert A. Hackenberg, East Lyme, Conn.

[73] Assignee: Robertson Paper Box Co., Inc., Montville, Conn.

[21] Appl. No.: 206,063

[22] Filed: Nov. 12, 1980

[51] Int. Cl.[3] ..... B65D 73/00; B65D 5/36

[52] U.S. Cl. ..... 206/486; 229/41 B; 206/446; 206/427; 206/562

[58] Field of Search ..... 206/486, 446, 488–490, 206/427, 562, 563; 229/41 R, 41 B

[56] References Cited

U.S. PATENT DOCUMENTS

| | | | |
|---|---|---|---|
| 1,353,629 | 9/1920 | Cibulka | 229/41 B |
| 2,018,171 | 10/1935 | Himes | 229/41 B |
| 2,411,144 | 11/1946 | Bergstein | 229/41 B |
| 2,547,716 | 4/1951 | Murphy | 229/41 B |
| 3,539,089 | 11/1970 | Osberg | 229/41 B |
| 3,804,321 | 4/1974 | Forbes, Jr. | 229/41 B |
| 3,836,065 | 9/1974 | Hackenberg | 229/41 B |
| 4,007,869 | 2/1977 | Stolkin et al. | 229/41 B |

*Primary Examiner*—Joseph Man-Fu Moy

*Attorney, Agent, or Firm*—Cesari and McKenna

[57] ABSTRACT

A folding auto platform carton having a lock bottom includes two similar platform sections which fold down with the bottom panels. When the carton is set up, each platform section forms with the underlying bottom panel a box girder which rigidifies the carton. Also abutting walls of the two box girders form a medial reinforcing and supporting rib extending all along the platform which prevents platform sag.

14 Claims, 8 Drawing Figures

AUTO PLATFORM CARTON

This invention relates to a folding paper box or carton. It relates more particularly to a carton of this type which includes an integral platform spaced above the carton bottom wall for retaining and isolating articles within the carton, which platform automatically folds down into place when the carton is erected.

BACKGROUND OF THE INVENTION

The carton with which we are concerned here has a so-called lock bottom which folds down into position when the carton walls are squared up. At the same time, a platform formed integrally with the carton walls folds down into place so that it is spaced above the carton bottom wall. Usually, openings are formed in the platform for receiving, retaining and isolating vials, bottles or other fragile articles contained in the carton. A carton of this general type is disclosed in U.S. Pat. No. 3,089,631 owned by the assignee of the present application.

As seen from that patent, the platform created in that prior carton comprises a single panel which spans the entire bottom wall and is unsupported other than at its edges. Accordingly, the platform tends to sag, with the result that the articles retained by the platform are not supported and isolated as well as they might be. Consequently, when that carton is handled roughly, the articles may smash against one another and break.

Also, in the prior carton construction, in order to lock the carton bottom wall and platform in place when the carton is set up, tab-receiving slots must be provided in one or more of the carton walls. Such slots provide access into the carton for dirt, moisture and insects, which can ruin the carton contents, particularly if the filled carton has a relatively long shelf-life.

Also, prior boxes of this type, typified by the one described in the aforesaid patent, are relatively expensive to make because of wastage of paperboard material due to the shape of the blank used to form the prior carton. For all of the aforesaid reasons, auto platform cartons generally have not seen as much use as might be desired.

SUMMARY OF THE INVENTION

Accordingly, it is an object of the present invention to provide an improved particularly strong auto platform carton.

Another object of the invention is to provide an improved carton of this type whose platform is supported intermediate its edges so that it remains spaced from the carton bottom wall over its entire area and does not tend to sag.

Another object of the invention is to provide an auto platform carton which affords greater protection for fragile articles.

Yet another object of the invention is to provide a carton of this general type which has bottom wall panels which automatically lock when the carton is erected.

Another object of the invention is to provide an auto platform carton having no wall openings by which dirt, moisture and insects can invade the carton.

Yet another object of the invention is to provide an auto platform carton which requires less paperboard material than other prior comparable cartons of this general type.

A further object of the invention is to provide a blank for forming an auto platform carton having one or more of the aforesaid characteristics.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

In general, my improved auto platform carton includes the usual front, rear and side walls hinged together to form a rectangular enclosure. Bottom wall panels are hinged to the lower edges of those four walls and these panels interfit so that when the carton is squared up, the panels form a bottom wall for the carton. The usual cover flaps are hinged to the upper edges of the carton side walls and when folded down into place, the cover flaps close off the top of the carton.

Further, platform panels are hinged to opposite bottom and side wall panels of the carton, forming a pair of more or less mirror image platform sections. When the carton is in its knocked-down or flattened condition, the platform panels along with the bottom wall panels are sandwiched between the carton wall panels forming a very compact package, so that a large number of the knocked-down cartons can be stored in a minimum amount of space.

However, when the carton is squared up and as the carton bottom walls fold down into place, the panels forming the platform sections fold away from the carton wall panels so that the platform sections swing down toward one another much like the two sides of a drawbridge. Each said section is supported above the underlying carton bottom wall panels to which it is hinged all around the perimeter of the platform section. Resultantly, when the carton is in its fully erected position, an elevated platform is formed which is spaced above and parallel to the carton bottom wall. Also, each partition panel defines with the underlying wallpanel a box girder which rigidifies the carton and prevents it from racking. Furthermore, when the two platform sections swing down together, a reinforcing rib is formed which extends along a horizontal axis of the carton and which reinforces the elevated platform as a whole and prevents it from sagging.

Appropriate openings are formed in the platform sections to receive fragile articles such as bottles. These openings are situated so as to retain and isolate the articles from one another and prevent them from smashing together during shipping and handling of the carton and its contents.

Also, locking tabs are formed integrally with the bottom wall panels so that, when the carton is erected, these tabs interfit and interlock so as to maintain the bottom wall, the platform sections and the carton as a whole in a fully squared-up condition.

Despite having all of the aforesaid advantages, the present carton can be made from a single cardboard blank which is designed so as to utilize a minimum amount of board stock and to be folded into its finished form using conventional folding and glueing apparatus. Therefore, the cost of the carton is kept to a minimum.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENT

Figure 1:
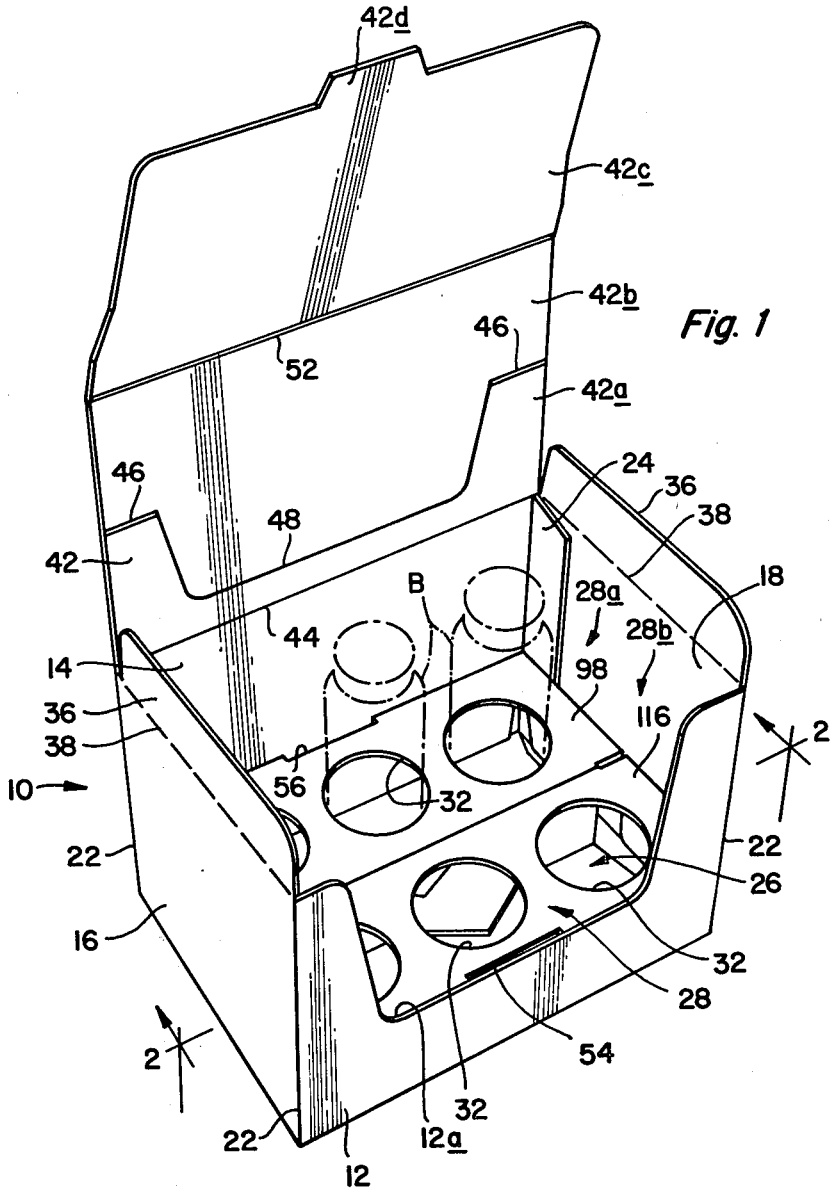
FIG. 1 is a perspective view of the carton embodying the principles of the invention.

Referring to FIG. 1 of the drawings, the subject carton indicated generally at 10 has a front wall panel 12, a rear wall panel 14 and a pair of side wall panels 16 and 18, all of which are hinged together along fold lines 22 to define a generally rectangular enclosure. The integrity of the enclosure is maintained by a glue flap 24 hinged to the rear wall panel 14 and adhered to side wall panel 18.

The carton is provided with a so-called lock bottom type bottom wall indicated generally at 26 and to be described in more detail later. Spaced above bottom wall 26 is a platform indicated generally at 28 which is provided with openings 32 for receiving fragile articles such as the glass bottles indicated in dotted lines at B. The platform openings 32 are sized to snugly retain the bottles B and are spaced apart so as to isolate those articles from one another and prevent them from being smashed together during shipping and handling of the carton.

The upper end of the carton 10 is closed off by the usual auxiliary cover flaps 36 hinged at 38 to the carton side walls 16 and 18. The main cover flap 42 is hinged at 44 to the upper edge of the carton rear wall 14. The cover flap 42 may assume any one of a number of standard configurations. The illustrated carton 10 is designed to display the contents B at the point of sale. Accordingly, the carton front wall 12 is provided with a large cut-out or notch **12*a*** so that the carton contents B are readily visible and can be withdrawn easily from the carton.

Also, the cover flap 42 is actually composed of three separate hinged-together panels **42*a*, 42*b* and 42*c*. The first two panels are connected together by a pair of colinear hinges 46 adjacent the side edges of those panels, the two hinges being connected together by a U-shaped interrupted cut line 48. The cover flap panels 42*b* and 42*c*, on the other hand, are connected together by a continuous hinge 52. The dimensions of the panels 42*a* and 42*b* considered together correspond to the dimensions of the top opening into the carton. Furthermore, the interrupted cut line 48 initially maintains those panels in a coplanar condition so that, when the cover flap 42 as a whole is folded down into place, the panels 42*a* and 42*b* close off the top of the carton, while the panel 42*c* extends down behind the carton front wall 12 completely closing the notch 12*a* therein. A tab 42*d* formed at the leading edge of the flap panel 42*c* projects down into a vertical slot 54 formed in the platform 28 just behind carton wall 12** so as to lock the cover flap in place.

Figure 2:
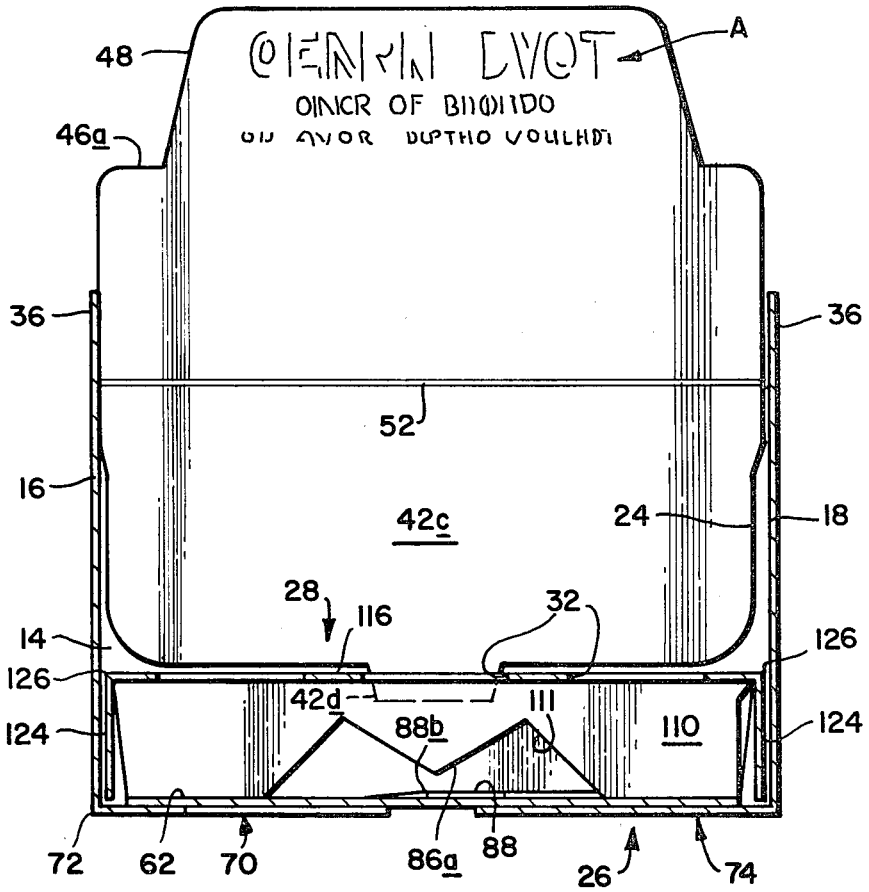
FIG. 2 is a sectional view along line 2—2 of FIG. 1, but with the carton cover flap in its folded back position to function as an advertising display.

On the other hand, at the point of sale, the interruptions in the cut line 48 can be broken permitting the cover flap panel **42*b* to be folded back against panel 42*a* with the flap panel 42*c* extending down adjacent the inner surface of the carton rear wall 14 as best seen in FIG. 2. The downwardly projecting flap tab 42*d* then projects into a slot 56 formed at the rear of platform 28 just inside the rear wall so as to lock the cover flap in that position. Suitable advertising indicia indicated at A in FIG. 2 can be provided on the portion of flap panel 42*b*** projecting above the bottles B so that it is readily visible to the purchaser at the point of sale.

Figure 3:
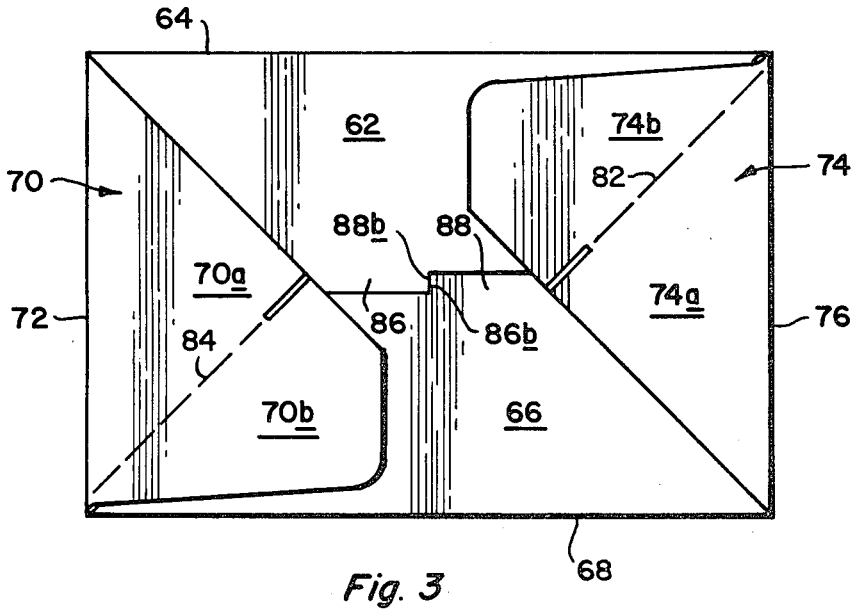
FIG. 3 is a bottom view of the FIG. 1 carton.

Referring now to FIGS. 2 and 3, the carton bottom wall 26 might be called a lock bottom. In this, it is composed of an elongated front panel 62 hinged at 64 to the lower edge of the carton front wall 12 and a similar rear panel 66 hinged at 68 to the lower edge of the carton rear wall 14. Wall 26 is completed by a pair of end panels 70 and 74. Panels 70 and 74 are hinged at 72 and 76 to the lower edges of the carton side walls 16 and 18 respectively.

Panels 70 and 74 are, in turn, divided into two sections by hinges 84 and 82 respectively. Section **70*a* and 74*a* of each panel 70 and 74 is in the form of an isosceles triangle whose apex is positioned more or less on the line separating panels 62 and 66. The other sections 70*b* and 74*b* of panels 70 and 74 respectively are essentially glue flaps which are adhered to bottom wall panels 66 and 62 respectively. Thus effectively panel sections 70*a* and 74*a* form gussets between panels 62 and 66**.

Figure 5:
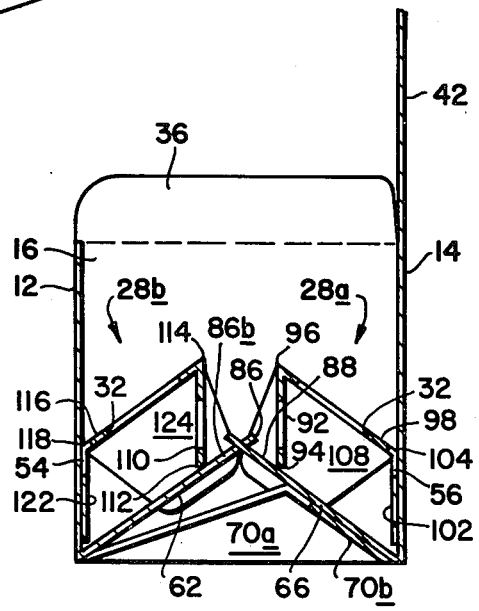
FIG. 5 is a sectional view along line 5—5 of FIG. 4.
Figure 6:
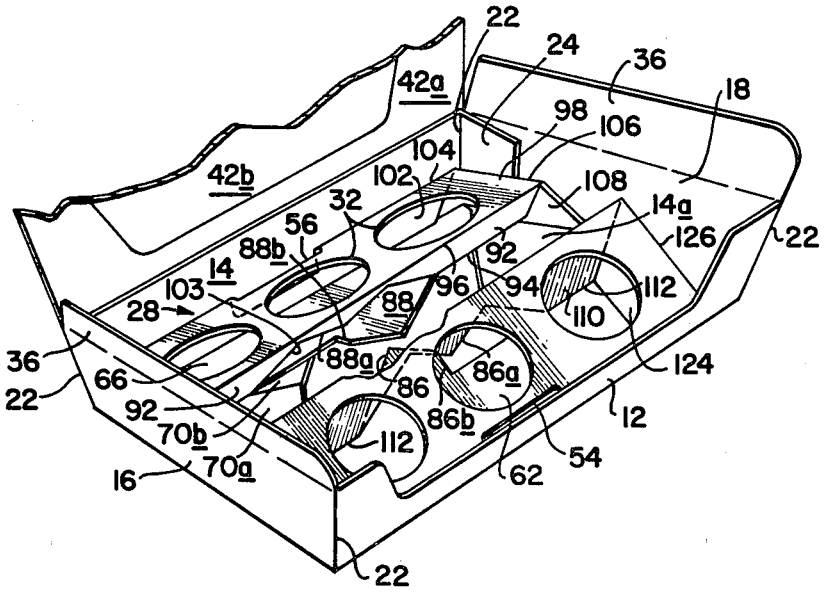
FIG. 6 is a perspective view with parts cut away illustrating the FIG. 1 carton in a nearly knocked-down or flattened condition.

When the carton 10 is in its fully erected position shown in FIGS. 2 and 3, the various bottom wall panels 62, 66, 70 and 74 fold down and interfit to completely close off the bottom of the carton. Generally triangular locking tabs 86 and 88 are provided on the opposing edges of the bottom wall panels 62 and 66 respectively as best seen in FIGS. 3, 5 and 6. The tabs 86 and 88 are offset from one another along the width of the carton so that, when the box is partially erected as shown in FIGS. 5 and 6, the opposing inclined tab edges **86*a* and 88*a* engage one another. Further squaring up of the carton flexes the tabs. However, those engaging tab edges are relieved at the roots of the tabs as indicated at edge segments 86*b* and 88*b* so that when the box is in its fully erected position with the bottom wall panels substantially coplanar, the engaging tab edges clear one another at their relieved segments 86*b* and 88*b***, permitting the tabs to snap back to their normal unflexed conditions thereby locking the bottom wall panels in place as shown in FIGS. 2 and 3.

Figure 4:
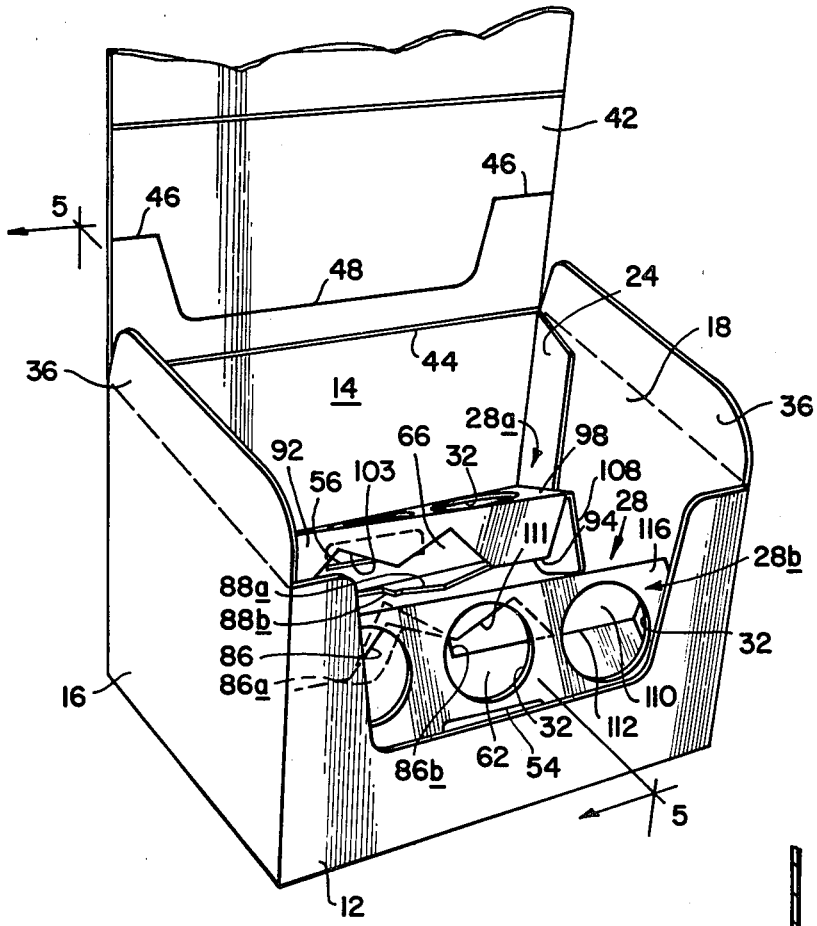
FIG. 4 is a perspective view with parts cut away showing the FIG. 1 carton in a partially knocked-down position.

Referring now to FIGS. 1, 2, 5 and 6, the platform 28 comprises a pair of more or less mirror image platform sections **28*a* and 28*b*. These sections lower more or less like two sides of a drawbridge as the box is squared up as illustrated in FIGS. 6, 4 and 1 to form the horizontal platform 28 spaced above the carton bottom wall 26. As best seen in FIGS. 5 and 6, platform section 28*a* comprises a rectangular panel 92 hinged at 94 to the free long edge of the bottom wall panel 66. Hinged to the opposite edge of panel 92 at hinge line 96 is a second rectangular panel 98 which contains the bottle-receiving openings 32. A rectangular glue flap 102 hinged at 104 to the opposite edge of panel 98 is adhered to the carton rear wall 14. Bottom wall locking tab 88 is struck from panel 92. Also, an opening 103 is formed in panel 92 to provide clearance for the locking tab 86 when the box is erected. Further, hinged to the opposite ends of panel 98 at lines 106 are a pair of vertical tabs 108. The tab-receiving slot 56 referred to in connection with FIG. 1 is formed at the hinge line 104** intermediate its ends.

Platform section 28*b* comprises a similar set of panels hingedly connected to the free long edge of the bottom wall panel 62. More particularly, and as best seen in FIGS. 2, 4 and 5, a panel 110 from which the locking tab 86 and a tab 88-receiving opening 111 are struck is hinged at 112 to panel 62. Hinged to the opposite edge of that panel along line 114 is a rectangular panel 116 from which the openings 32 are struck. Finally, hinged to the opposite long edge of panel 116 along hinge line 118 is a panel 122 from which the slit 54 is struck. Finally, a pair of flaps 124 are hinged along hinge lines 126 to the opposite ends of panel 116. Thus the panel sections 28*a* and 28*b* are composed of more or less identical panels and flaps except for the lateral displacement of locking tabs 86 and 88 and their tab-receiving openings 103 and 111 respectively.

Figure 7:
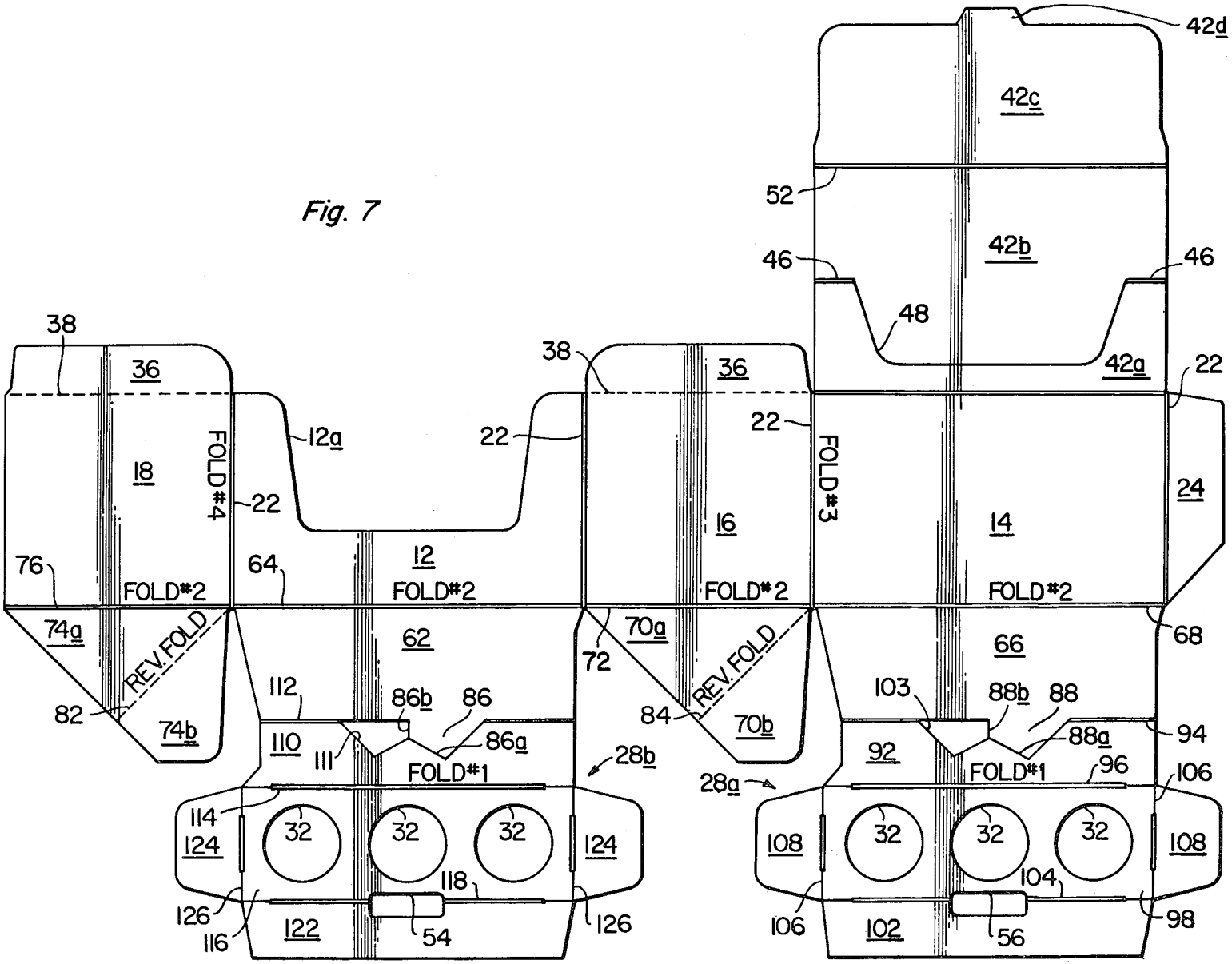
FIG. 7 is a top plan view illustrating the carton blank from which the FIG. 1 carton is formed.
Figure 8:
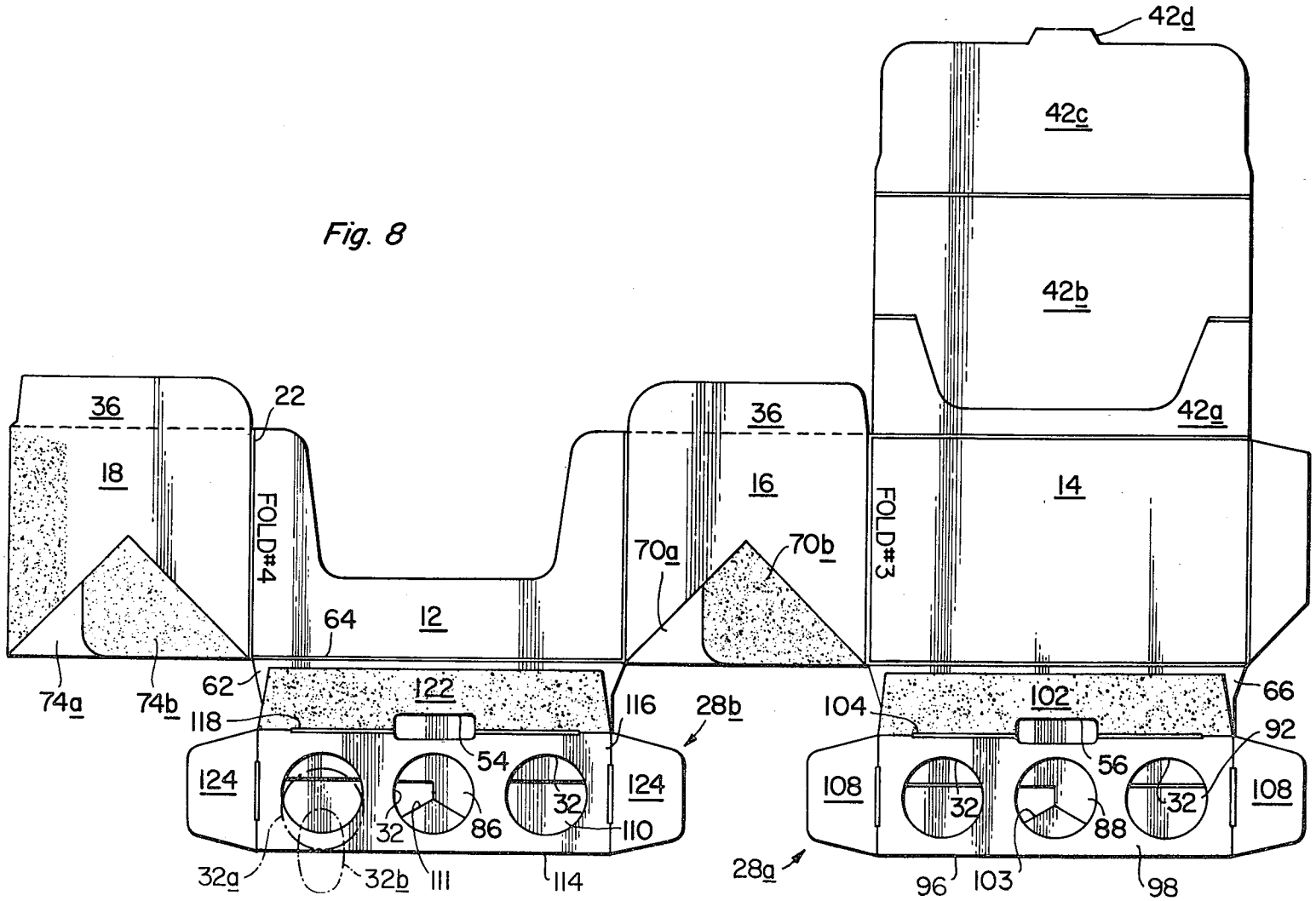
FIG. 8 is a similar view showing the carton blank partially folded to form the finished carton.

The carton 10 is made from a single cardboard blank illustrated in FIG. 7. That blank is more or less rectangular so that a string of such blanks can be laid out on a web such that they overlap so that there is minimum wastage of board material. After each blank is cut out, it is first folded along hinge lines 96 and 114 so that panels 98 and 116 overlie panels 66 and 62 respectively. Next as shown in FIG. 8, the blank is folded along hinge lines 64, 68, 72 and 76 with reverse folds being made at hinge lines 82 and 84 so that panel 62 as well as the folded back panel 116 overlie panel 12 and so that panels 66 and 98 overlie panel 14 with the rectangular panel sections 70*a* and 74*a* overlying panels 16 and 18 respectively. In FIG. 8, only the latter two triangular panels are shown folded so that the areas of the blank to which adhesive is applied can be indicated by stippling.

When the panels 66 and 62 are folded as aforesaid, the glue flaps 102 and 122 adhere to the lower edge margins of panels 14 and 12 respectively. The third fold is made at the hinge line 22 dividing panels 14 and 16 so that panel 14 overlies panels 12 and 16. This results in panel section 70*b* being adhered to panel 66. The final fold line is made along the hinge line 22 dividing panels 12 and 18 which results in panel section 74*b* adhering to panel 62 and the glue flap 24 adhering to panel 18. The carton is shipped and stored in this flattened condition until ready for use.

To erect the box, the opposite side edges of the flattened carton are pressed together, resulting in the box walls forming up into a generally rectangular enclosure. As the box walls square up, the bottom wall panels gradually fold down into place, drawing the platform panels down with them as illustrated in FIG. 6, more or less like the two sections of a drawbridge. As the carton progresses toward its fully erected position, the locking tabs 86 and 88 on the bottom wall panels 62 and 66 engage one another as best shown in FIG. 5. Further squaring up of the carton causes the tabs 86 and 88 to project through the openings 103 and 111 permitting the bottom wall panels to reach their lowest coplanar position. At this point, the relieved tab edge segments 86*b* and 88*b* oppose one another, thereby relieving the stress on the tabs, permitting them to snap back to their unstressed positions, so that the bottom wall panels are locked in place, fully closing off the bottom of the carton as illustrated in FIGS. 2 and 3.

Also as shown in FIGS. 1, 5 and 6, the two platform panel sections 28*a* and 28*b* swing down along with the bottom wall panels so that the platform panels 98 and 116 form a substantially continuous horizontal surface spaced above the carton bottom wall. The platform panels 98 and 116 which together support the contained articles B are themselves supported all around their perimeters. More particularly and as best seen in FIG. 5, platform panel 98 is spaced above the bottom wall panels along its long edges by the glue flap 102 adhered to panel 14 and by panel 92 hinged to the bottom wall panel 66. That same panel is spaced above the bottom wall at its shorter edges or ends by the tabs 108 which engage the bottom wall. Likewise panel 116 is supported above the bottom wall by a glue flap 122, panel 110 and the end tabs 124. Thus each platform section and its underlying bottom wall panel together form a box girder and the two box girders rigidify greatly the bottom of the carton. Furthermore, the abutting panels 92 and 110 of the two platform sections form a rigid lateral medial supporting and reinforcing beam which extends the entire width of the platform. Therefore, the platform does not tend to sag and the platform as well as the carton as a whole are quite resistant to racking.

It should be noted also that the locking of the carton in its erected position does not require any slots or other openings in the walls of the carton that might permit entrance of dirt, moisture and insects which could be harmful to the carton contents.

The openings 32 in the platform 28 can have more or less any size and shape commensurate with the dimensions of the platform sections and the contents B. Also, in order to minimize the depth of the box to save material and packing space, the openings 32 can be located closer to the hinge lines 96 and 114. This is illustrated by the dotted line opening 32*a* at the left hand end of platform panel 116 in FIG. 8. The disadvantage of this, of course, is that there is less separation between the article in opening 32*a* and a corresponding article in an opposite similar opening in panel 98. This disadvantage can be overcome while still positioning the openings at those close together locations by cutting the opening 32*a* in the form of a large pie section, i.e. leaving a tab adjacent the hinge line 114 as indicated at 32*b* in FIG. 8. Then when the platform panel is folded as shown in that figure, the tab 32*b* will project out below the hinge line as also indicated in that figure. Consequently, when the box is made up and erected, the tab 32*b* will project up from the platform between the articles contained in the adjacent platform openings, thereby isolating them. Tab 32*b* cannot be too long, however. Otherwise, it will be engaged by the folding apparatus and folded along with the platform panel 116. In that event, it would remain more or less in the plane of that platform panel so that when an article B is inserted into the opening 32*a*, the tab would be pushed down under the platform and not be able to perform its isolating function.

It will be seen from the foregoing, then, that the present carton construction provides a rigid stable platform for isolating and cushioning fragile articles in a lock-bottom carton. When the carton is erected, the carton bottom walls are locked in place so that they completely close the bottom of the box while the platform is maintained in a fixed spaced relationship above the bottom wall. Furthermore, no openings need be made in the walls of the carton to maintain the carton in its open, locked condition. Further, prior to its use, the carton can be flattened so that it can be shipped and stored in a minimum amount of space. Yet with all of these advantages, the carton can be formed from a single cardboard blank using a minimum amount of board stock.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. A folding carton for containing fragile articles comprising

A. four wall panels hinged together for collapsing into a flat structure and opening up to form a generally rectangular tube, B. a lock bottom for the carton, said bottom comprising (1) a pair of parallel, generally rectangular bottom panels hinged to one pair of opposite carton wall panels and extending between the other pair of opposite carton wall panels, and (2) a pair of gusset panels hinged to said other pair of wall panels and to the rectangular bottom panels, said bottom panels being foldable up inside the collapsed structure and opening out to occupy a substantially common plane perpendicular to the wall panels when the carton is set up, and C. a platform foldable up inside the collapsed structure and spaced above the carton bottom panels when the carton is set up, said platform comprising a pair of similar mating platform sections, each section including (1) a generally rectangular platform panel hinged at one edge to one panel in said first pair of wall panels, and (2) a support panel hinged to the opposite edge of said platform panel and also to the underlying rectangular bottom panel so that, when the carton is set up, the platform panels swing down into a substantially common plane above the plane of the bottom panels with the support panels abutting one another to form a medial reinforcing rib between the platform and the carton bottom all along the platform which inhibits platform sag and rigidifies the carton as a whole.

2. The carton defined in claim 1 and further including means defining openings in each platform panel for receiving and retaining the articles so as to isolate them from one another.

3. The carton defined in claim 2 wherein the openings in each platform panel are spaced from the hinged line connecting that platform panel and its support panel.

4. The carton defined in claim 2 wherein the openings in each platform panel extend to the hinge line between that panel and its support panel.

5. The carton defined in claim 4 wherein each opening is formed so as to create a tab at said hinge line which projects upwards when the carton is set up so that the tabs separate articles retained in corresponding openings in the two platform panels on opposite sides of the rib.

6. The carton defined in claim 1 and further including flaps hinged to the opposite ends of each platform panel adjacent the other pair of carton walls and extending perpendicular to the corresponding support panel, said flaps engaging the carton bottom when the carton is set up so as to support the opposite ends of each platform panel.

7. The carton defined in claim 1 and further including a tab formed at the edge of each rectangular bottom panel remote from the hinge connection of that panel to the carton wall panel, said tabs being brought into edge-to-edge engagement as the carton is set up so as to flex the tabs, at least one said tab being relieved adjacent its root so that, when the carton bottom panels are substantially coplanar, there is sufficient clearance between the tab edges so as to permit them to resume their normal unstressed conditions whereupon they lock the bottom panels in place.

8. The carton defined in claim 7 and further including means defining an opening in the support panel of each platform section for receiving the tab formed in the bottom panel underlying the opposite platform section so as to permit the tabs to repose in the common plane of said bottom panels when the carton is set up.

9. The carton defined in claim 1 and further including cover flaps hinged to the upper edges of at least three of said carton wall panels.

10. A collapsible carton comprising

A. four wall panels hinged together to form a generally rectangular tube,

B. a pair of generally rectangular bottom panels hinged to a first pair of opposite wall panels, C. a pair of gusset panels hinged to the other pair of opposite wall panels and to the rectangular panels so that when the wall panels assume their tubular form when the carton is set up, the bottom panels fold down so that they lie essentially in a common plane which is perpendicular to the planes of the wall panels, D. a foldable platform spaced above the carton bottom, said platform comprising a pair of similar sections, each section including a platform panel having one edge hinged to a panel of said first wall panel pair and a support panel hinged to the edge of the platform panel remote from its hinge connection to the wall panel, said support panel also being hinged to the rectangular bottom panel underlying said platform panel so that each platform section constitutes part of a box girder which extends between the other pair of carton wall panels when the carton is set up so as to prevent platform sag and to rigidify the carton as a whole.

11. The carton defined in claim 10 and further including means defining one or more openings in each platform panel for receiving and retaining articles to be transported in the carton.

12. The carton defined in claim 10 and further including flexible locking tabs formed on the opposing edges of the rectangular bottom panels, said locking tabs being brought into edge-to-edge engagement as the carton is set up so that the tabs flex, and means defining an edge relief at the root of at least one tab which permits the tabs to resume their normal unstressed positions when the carton bottom panels assume their fully open coplanar positions thereby locking the carton in its set up condition.

13. The carton defined in claim 12 and further including means defining an opening in the support panel in each platform section for receiving the locking tab at the edge of the bottom panel underlying the other platform section so that when the carton is set up, the locking tabs can lie more or less in the same plane as the bottom panels.

14. The carton defined in claim 13 and further including flaps formed at opposite ends of each platform panel, said flaps extending generally perpendicular to the support panel hinged to that platform panel and engaging the carton bottom when the carton is set up so as to provide support at the ends of the platform sections.

* * * * *